United States Patent [19]

Luckenbach

[11] 4,185,364

[45] Jan. 29, 1980

[54] METHOD OF MAKING MULTICOLORED YARN

[75] Inventor: Roy Luckenbach, Asheboro, N.C.

[73] Assignee: Roselon Industries, Inc., Philadelphia, Pa.

[21] Appl. No.: 888,464

[22] Filed: Mar. 20, 1978

Related U.S. Application Data

[63] Continuation-in-part of Ser. No. 884,276, Mar. 7, 1978, abandoned, which is a continuation of Ser. No. 688,630, May 21, 1976, abandoned.

[51] Int. Cl.[2] ..... D02G 1/00; D04B 19/00

[52] U.S. Cl. ..... 28/218; 66/147; 101/172; 101/211

[58] Field of Search ..... 8/150; 28/178, 218; 66/147; 68/5 C; 101/172, 180, 211

[56] References Cited

U.S. PATENT DOCUMENTS

| | | | |
|---|---|---|---|
| 590,245 | 9/1897 | Stokes | 101/172 |
| 1,758,665 | 5/1930 | Hofner | 66/147 X |
| 2,020,694 | 11/1935 | Mauritsch et al. | 66/147 |
| 3,333,441 | 8/1967 | Soussloff et al. | 28/218 X |
| 3,701,315 | 10/1972 | Maund | 28/218 X |
| 3,720,984 | 3/1973 | Roberson, Jr. | 28/218 |
| 3,803,880 | 4/1974 | Laing et al. | 28/218 X |
| 3,849,847 | 11/1974 | Corbiere | 28/218 |
| 3,871,196 | 3/1975 | Matsunaga | 28/218 X |
| 3,875,677 | 4/1975 | McWhirter | 68/5 C X |
| 3,908,247 | 9/1975 | Murphy | 28/178 |
| 3,919,749 | 11/1975 | McWhirter et al. | 28/218 |
| 3,955,227 | 5/1976 | Siegfried | 8/150 |

FOREIGN PATENT DOCUMENTS

| | | | |
|---|---|---|---|
| 813022 | 5/1969 | Canada | 28/218 |
| 1453387 | 8/1966 | France | 28/218 |
| 3020 | of 1853 | United Kingdom | 28/218 |
| 376720 | of 1932 | United Kingdom | 101/180 |

OTHER PUBLICATIONS

*Production Techniques,* Hoisery and Underwear, pp. 62, 64, 65, Oct. 1969.

*Printed Knit-de-Knit Yarns Go Shag,* Textile World, 124(5): pp. 145, 146, 148. May, 1974.

Carpet Yarn Printing Goes Tensionless, Textile World, 125(10): pp. 105, 106, 108, Oct., 1975.

*Primary Examiner*—Robert Mackey

*Attorney, Agent, or Firm*—Miller & Prestia

[57] ABSTRACT

A method is provided for making a multicolored yarn, in which the yarn is knitted into a tubular pre-fabric tape, the tape is straightened and flattened freeing it of any folds or wrinkles or the like, and is fed wale-wise in a straightened and flattened condition and printed with a multicolored design having a multiplicity of different colors in the course-wise direction, at least about every half inch or less. The resulting printed tape is set, dek-nitted and the resulting multicolored yarn is taken up. The yarn product has a multiplicity of short dashes of at least five different colors arranged adjacent each other along the yarn direction, and the dashes have an average length of about one inch or less.

Fabric composed of the yarn, preferably of an apparel denier, has a pleasing multicolored effect.

23 Claims, 17 Drawing Figures

FIG. 2.
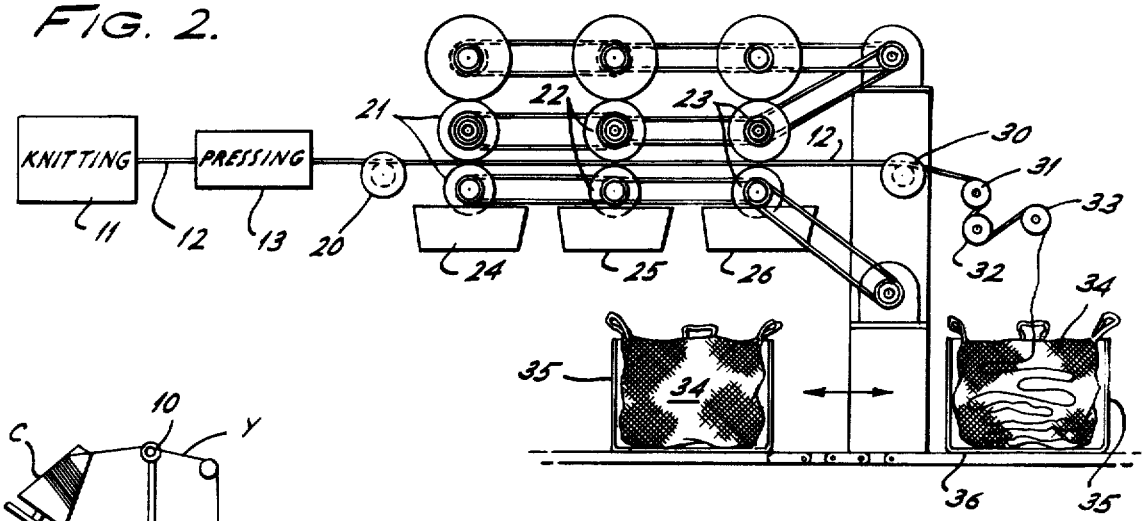
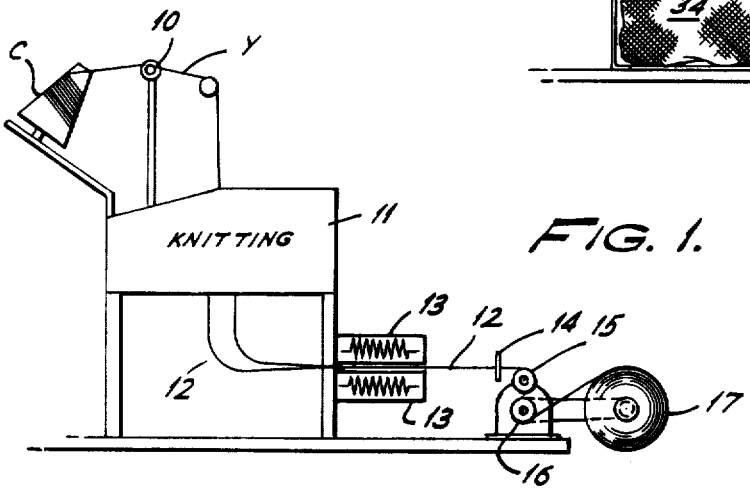
FIG. 1.
FIG. 3.
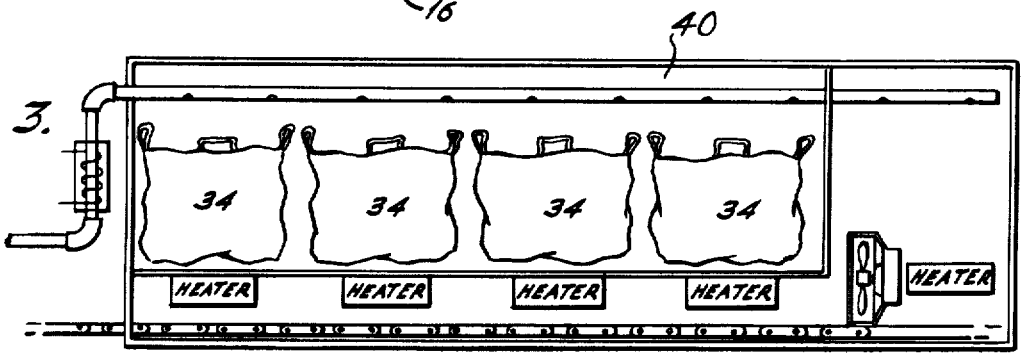
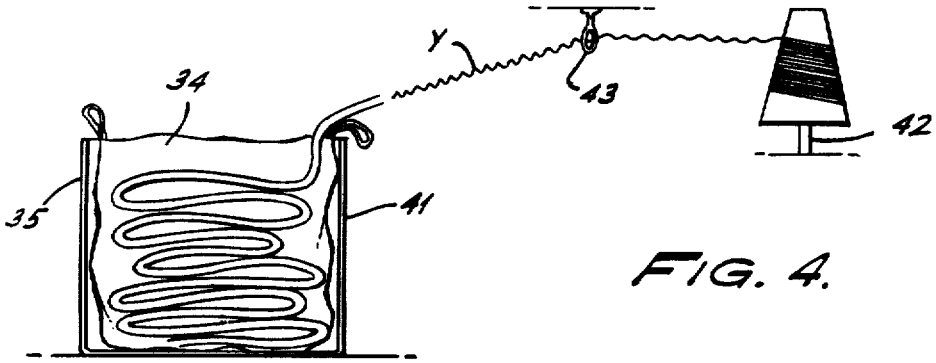
FIG. 4.

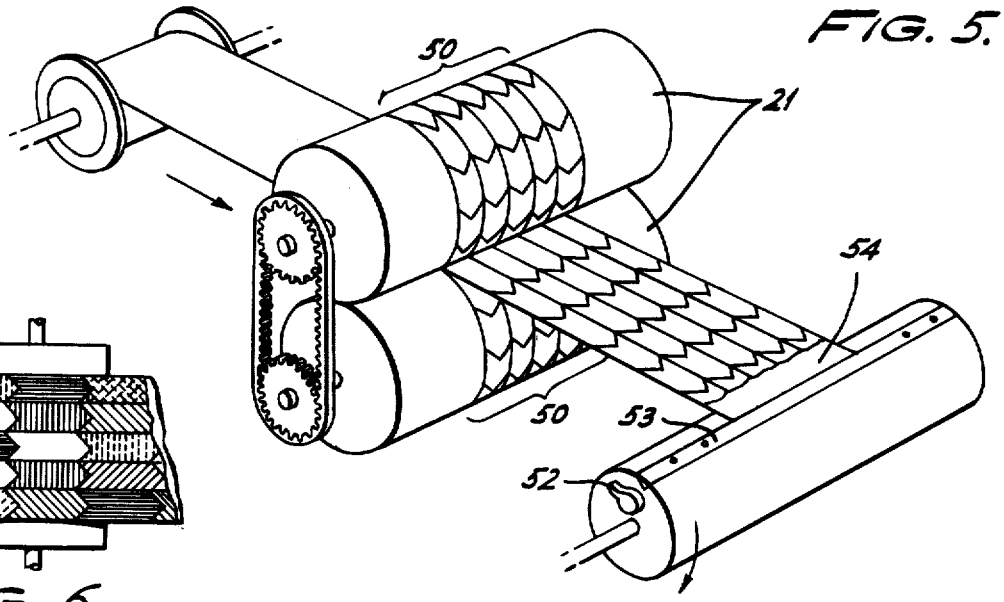
FIG. 5.
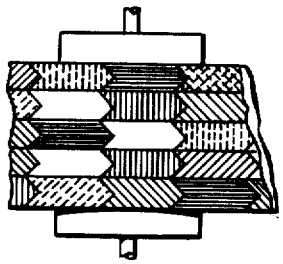
FIG. 6.
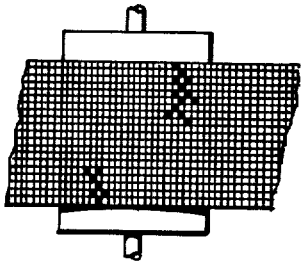
FIG. 7.
FIG. 8.
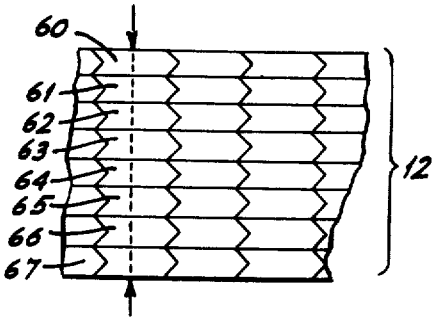
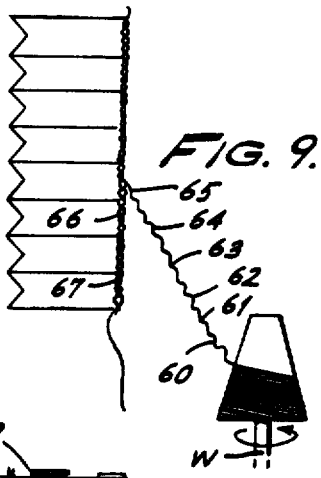
FIG. 9.
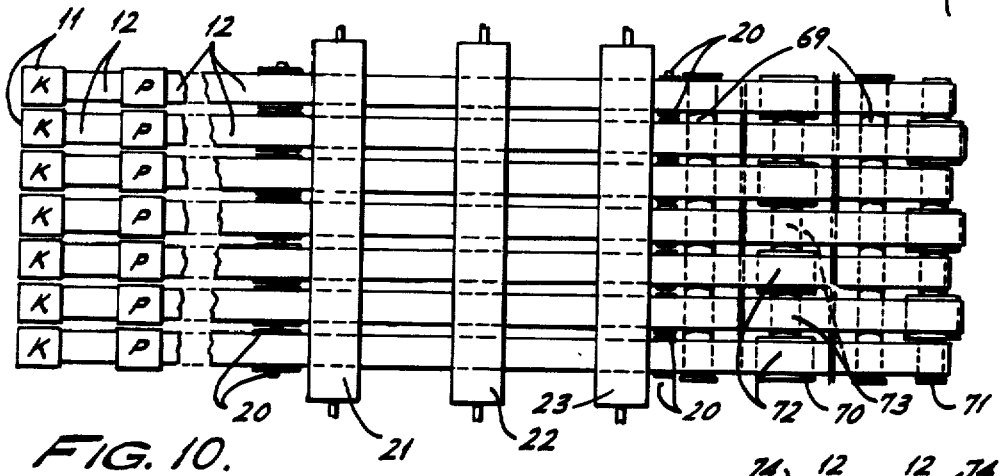
FIG. 10.
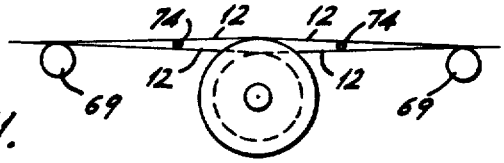
FIG. 11.

METHOD OF MAKING MULTICOLORED YARN

CROSS REFERENCE TO RELATED ART

This is a continuation-in-part of the application Ser. No. 884,276 filed on Mar. 7, 1978, now abandoned, which is itself a continuation of application Ser. No. 688,630, filed May 21, 1976, now abandoned.

DISCUSSION OF THE PRIOR ART

It is known in the art, as indicated by the U.S. Pat. No. 3,605,225 to Gibson et al, to form a fabric and then to print diagonal stripes on the fabric, followed by disassembling the fabric as by de-weaving, to produce a multiplicity of multicolored yarns. In such a process, which is applied to heavy yarns of carpet denier or the like, the diagonal strips occur regularly across the width of the fabric and although multiple colors may be used, the maximum practical number of colors is three or four. Printing in accordance with the patent to Gibson et al may be combined with pad dyeing but even then the total number of colors applicable to the yarn is severely limited.

Similar processes have been applied with the use of a knitted tubing, followed by de-knitting, as indicated by the U.S. Pat. Nos, 3,012,303, 3,102,322 and 3,543,359, to Whitaker, the latter of which utilizes an undrawn yarn.

It is also known to knit textile yarn into a tube and to freely dribble dye stuff onto the knitted tube in order to provide various colors to the yarn. The tube is then passed through rolls which press the tube flat and force differential migration of the dyestuff. The dyestuff is then set, and the tube is deknitted. However, free dribbling of dyestuff on the yarn provides a severe limitation as to the number of colors applied thereto, and prohibits precise control regarding specific areas and locations to which the specific colors of dyestuff shall be applied, thus providing corresponding limitations regarding the distribution of various clors of dyestuff along the length of the yarn product. The U.S. Pat. No. 3,828,405 to DeVinney discloses this concept.

Other procedures are known for space-treating fibers, including the so-called "resist" dyeing procedure as described in the U.S. Pat. No. 3,602,968 to Macknang et al. In this process a knitted tube or the like is provided with a plurality of apparently random colored patterns, by treating the tubing with a reagent to change the dye affinity of the fibers, and to impart a repetitive predetermined pattern of the reagents on the tubing. The tubing is then unravelled to provide yarn, the yarn is then fabricated into the final fabric, and then the finished fabric is piece-dyed with the utilization of the "resist" features of the chemicals incorporated into the yarn.

It is well known to utilize a heat transfer process for printing of patterns on finished fabrics. Such patterns are conventionally applied by the use of a heat transfer paper containing a dye. Such heat transfer procedures are reported, for example, in Canadian Textile Journal for February, 1975, in an article by W. A. B. Davidson entitled "Dupont of Canada Sees Substantial Growth in Heat Transfer Printing". However, the utilization of heat transfer paper for the space-treating of yarn is laborious, time consuming and expensive, and has not been found to produce yarn of the desired high degree of color brilliance. Such procedures have, in the past, utilized the gravure of flexographic processes to apply multicolored designs from printed paper to knitted or woven finished fabrics, utilizing various dyes including suitable disperse dyes, as reported in an article by Charles Reichman in Knitting Times, Mar. 24, 1975, page 21, entitled "Heat Transfer Business Registering Vigorous Growth". Various disperse dyes utilized for printing of polyester appear in the same issue of Knitting Times, at pages 24 to 26. The so-called "thermasol" dyes are described in American Dyestuff Reporter, Nov. 26, 1962 at pages 45 to 47 and 51, Chemical and Engineering News, Sept. 10, 1956, pages 4358 to 4361, American Dyestuff Reporter for Dec. 9, 1963, pages 91 to 98, American Dyestuff Reporter, Volume 41, No. 26, Dec. 22, 1952, pages 859 to 860, American Dyestuff Reporter for Dec. 7, 1964, pages 106 to 109, and American Dyestuff Reporter for Feb. 8, 1960, pages 50 to 54. Transfer printing utilizing a dyestuff which sublimes at a temperature below about 240° C., is shown in the U.S. Pat. No. 3,632,291 to Defago, and other procedures for transfer dyeing of synthetic textile materials are described in the U.S. Pat. No. 3,702,752 to Vent et al.

To the best of my knowledge it has not heretofore been possible or known to produce a yarn, preferably a yarn of apparel denier of about 70 to 500, or more preferably 70 to 150, having a multiplicity of different colors at least five in number, extending in short increments about one inch or less along the yarn. Further, the "spacetreating" processes commercially practiced have been centered substantially upon the production of very heavy denier yarns, such as carpet yarns and the like, and have not been capable of providing a multiplicity of colors ranging in number from five to fifteen or even more.

SUMMARY OF THE INVENTION

This invention relates to a method of making multicolored yarn, to the yarn produced, and to the fabric made of the yarn.

In accordance with the process of this invention, the yarn is knitted into a tubular prefabric tape, and the tape is straightened and flattened in order to free it of any folds, wrinkles or the like. The tape is then preheated, and is fed wale-wise in a straightened and flattened condition to a tape printing machine. In such a manner, multiple colors are printed in the form of a design, having a multiplicity of different colors extending in the coursewise direction at least about every half inch or less. The resulting printed tape is heat set, the yarn is deknitted from the tape, and the resulting multicolored yarn is taken up. The yarn has a multiplicity of short dashes of at least five different colors arranged adjacent each other along the yarn direction, and the dashes have an average length of about one inch or less. The fabric composed of such a yarn has a pleasing multicolored effect.

OBJECTS OF THE INVENTION

It is an object of this invention to provide a novel form of intermittently colored continuous filament synthetic polymeric or natural fiber yarn, wherein sequential portions of the yarn are dyed in different colors, and wherein each sequential portion is very short in length, such as one inch or less, and further wherein the total number of different colors sequentially arranged is at least about five and may extend up to fifteen or twenty or more.

It is a further objection of this invention to provide a beneficial and economical method for mass producing such yarn.

Still another object of this invention is to provide novel multicolored fabrics produced from yarns in accordance with this invention.

Other objects and advantages of this invention will appear in further detail hereinafter, and in the drawings.

DRAWINGS

Of the drawings:

FIG. 1 is a schematic view in side elevation illustrating certain process steps in accordance with a portion of one particular method in accordance with this invention;

FIG. 2 is a side elevational schematic view showing a continuous process utilizing features of this invention;

FIG. 3 is a view taken in side elevation showing an autoclave which is utilized in conjunction with the process of FIG. 1 or FIG. 2 of this invention;

FIG. 4 is a schematic view in side elevation, illustrating a deknitting step which is an important step in accordance with this invention;

FIG. 5 is a fragmentary view in perspective illustrating certain portions of a printing apparatus advantageously utilized in accordance with this invention;

FIGS. 6 and 7 are face views of typical printing rolls having specifically preferred patterns, for performing a printing process in accordance with this invention;

FIG. 8 illustrates a section of knitted tape, showing color distributions of typical patterns utilizing features of this invention;

FIG. 9 is a fragmentary end view of a knitted tape, showing it being de-knitted in accordance with this invention, and showing the sequential arrangements of short dashes of color, utilizing a multiplicity of different colors, on the yarn;

FIG. 10 is a plan view of an apparatus similar to FIG. 2, but showing multiple tapes, and apparatus and methods for handling them;

FIG. 11 is a fragmentary side view of the apparatus shown in FIG. 10, illustrating the manner in which interlacing yarns are interposed between the tapes;

Figure 16:
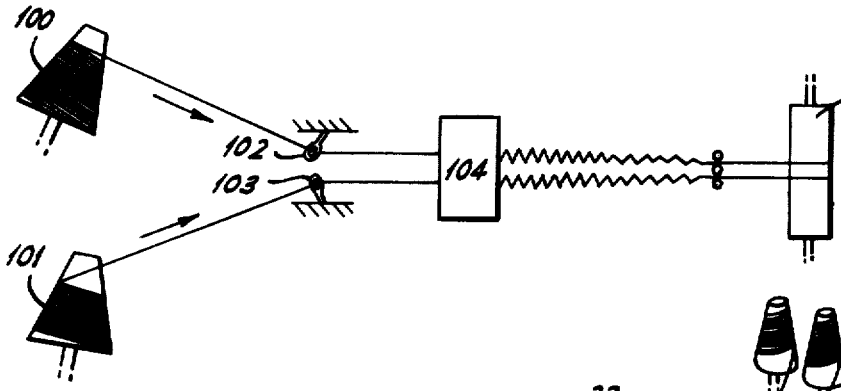
Figure 17:
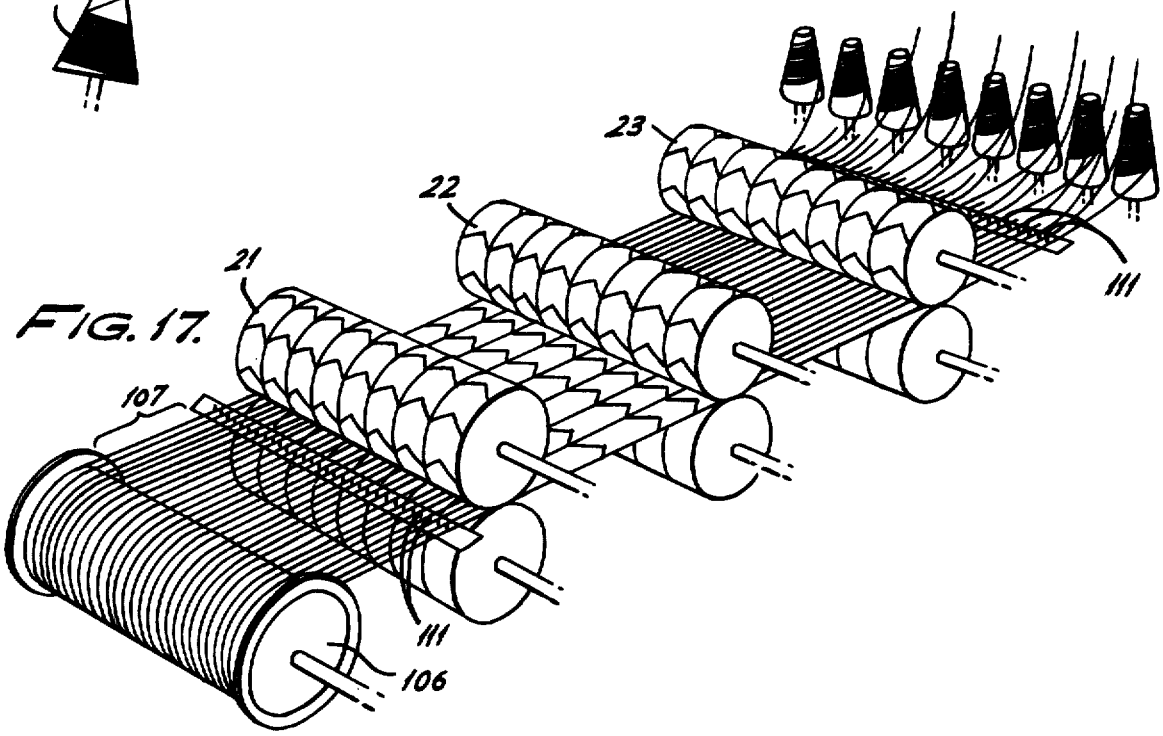

FIG. 16 is a plan view showing schematically an alternative form wherein the yarn is stuffer crimped and formed into a warp, instead of being knitted preparatory to the printing procedure in accordance with this invention; and FIG. 17 is a view in perspective similar to FIG. 16, but showing a multiplicity of yarns arranged as a warp, and subjected to pattern printing in accordance with this invention.

DESCRIPTION OF PREFERRED EMBODIMENTS

Although specific forms of the invention have been selected for illustration in the drawings, the following description is drawn in specific terms for the purpose of describing those forms of the invention; the description is not intended to define or to limit the scope of the invention, which is defined in the appended claims.

Referring now to the drawings, FIG. 1 shows the yarn Y being conducted from its cone C through a guide 10 to a knitting machine 11, producing a knitted tape 12. Details of the knitting machine 11 are not shown, since a wide variety of conventional circular knitting machines may be utilized, as is well known in the art.

The knitting machine 11 is provided with a pair of heater blocks 13, 13 through which the tubing 12 is conducted. The heater blocks are closely spaced, thus ironing out the tubing, freeing it of any folds, wrinkles or the like, and providing it in a straightened and flattened condition. They also pre-heat the tape 12.

The tape 12 is then passed between guide pins 14, 14 and passed over a motor driven roller 15 and through the nip between such roller 15 and the lower roller 16, and is then wound up on a beam 17 preparatory to further treatment, as will be explained in detail hereinafter.

FIG. 2 shows a continuous process, which utilizes as its first steps the steps just described in conjunction with FIG. 1. Again in FIG. 2, the number 11 designates the knitting machine, 12 designates the heater blocks which perform the pressing function, and the tubing 12 is fed between the flanges of an aligning spool 20 between the nips of a multiplicity of pairs of printing rolls 21, 22 and 23. Suitable dyesbaths are provided for each of the printing rolls, as indicated by the numbers 24, 25 and 26, all as is known in the printing art. Preferably the upper rolls 21, 22 and 23 are synchronized in rotation with each other, by chains and sprockets as shown. A similar relationship preferably exists between the lower printing rolls 21, 22 and 23.

The upper and lower printing rollers 21, 22; 22, 22 and 23, 23 may be either in synchronization or out of synchronization as they print upon both surfaces of the knitted tubing. As will be apparent from the subsequent discussion, the printed tubings 12 will provide a yarn having a randomness of color no matter whether the upper and lower rollers are in or out of synchronization. However, it has been discovered if the upper and lower rollers are out of synchronization, the finished yarn product has greater randomness of color than when the upper and lower rollers are in sychronization. As is apparent from FIG. 5, the upper and lower printing rolls each have a sprocket gear which engages a common chain. By means of engaging the sprocket gears into the common chain in a manner well known by those skilled in the art, the upper and lower rollers can be in or out of synchronization regarding the pattern which they are respectively printing on the top and bottom surfaces of the tubing 12.

It will be apparent that the rolls 21, 21 are arranged for printing a given color, preferably a primary color such as yellow or the like. Similarly, the rolls 22, 22 may be arranged for printing blue, and the rolls 23, 23 may be arranged for printing red. Each of these rolls has a specific and predetermined pattern, which is an important feature of this invention and will be further described in detail hereinafter. It has further been discovered that if the specific and predetermined patterns printed by each set of rollers somewhat overlaps the patterns printed by the other rollers, there is a resultant increase in the randomness of color of the finished yarn product.

The tube or tape 12, emerging from the nip between the rolls 23, 23, passes between flanges of an aligning spool 30 and passes over a motor drive roll 31, downwardly through the nip between it and the cooperating pressure roll 32, then over a guide roll 33 and downwardly into a net 34 contained within a container 35. Desirably, as shown, the container 35 is mounted on a reciprocable platform 36, which is capable of moving back and forth in a known manner, in order to flake the printed tape down in a serpentine fashion within the net 34.

Another net 34 and container 35 is provided on the platform 36, and is kept in readiness for use when the previous net 34 has been filled with printed tape. In this manner, alternate nets and containers may be utilized in order to continuously catch and retain the printed tape produced by the process illustrated in FIG. 2.

It will be appreciated that the portion of the process illustrated in FIG. 2 may be performed as a single process, as there illustrated, or may be performed in separate steps, first including the step shown in FIG. 1, followed by the step of unrolling the tape from the roll 17 and then feeding it under tension into the nip between the printing rolls 21, 21, followed by processing as illustrated in FIG. 2 of the drawings. In either event, the printed tubing is further processed as will now be described.

Turning to FIG. 3, an autoclave is shown. This may be of the general type appearing in my prior U.S. Pat. No. 3,431,656 granted Mar. 11, 1969. It will be appreciated that a multiplicity of nets 34, each containing printed tapes produced in accordance with the process heretofore described, are placed manually or otherwise into the autoclave 40, and steam is admitted through a pipe into the closed chamber in a manner to heat-set the yarn and to set the dye. It has been found that with the use of "disperse" dyes, and particularly in the dyeing of polyester utilizing disperse dyes, the autoclaving step not only provides excellent heat setting in the yarn but concurrently brings out the brilliance of the disperse dyes previously printed onto the tape.

After autoclaving, the containers or nets 34 are removed from the autoclave, and are placed into a supplemental container 41 (FIG. 4). Each tape is deknitted by connecting a loose end of the yarn to a winder 42 through a guide 43. In this manner, multicolored yarn produced is wound onto spools, bobbins or the like, producing finished packages of brilliant, multicolored yarn in accordance with this invention.

It is of great importance in accordance with this invention to apply patterns of specific size and configuration to the tape. Each pattern as shown comprises a multiplicity of individual areas having a predetermined width in the course-wise direction and a predetermined length in the wale-wise direction. As shown in FIG. 5, two typical rolls 21, 21 are provided with patterned surfaces 50, 50 each having a specific hexagonal design corresponding to the other, and either synchronized or unsynchronized with respect to each other. It was stated previously, that it has been discovered that when the upper and lower rolls 21, 21 are not synchronized so that the pattern surfaces 50, 50 are consequently not synchronized, the multicolored yarn produced has a greater degree of color randomness than if the upper and lower rollers were synchronized. It will be observed that the pattern 50, includes at least five hexagonal design units extending in the axial (course-wise) direction, so that at least five such units will be printed in the deknitting of course-wise direction of the tape. This is an important and advantageous feature of this invention, and it is particularly important that the axial (course-wise) dimension of each such hexagonal area be one-half inch or less. The wale-wise dimensions of each hexagonal area is also fixed and predetermined as shown. In this manner, a design is printed on the fabric which, in the course-wise direction, comprises at least five different colors, each of which occurs through a space of about one-half inch or less. Such an arrangement, after deknitting as will become further apparent hereinafter, produces a highly novel yarn having a distinctive and pleasing multicolored effect.

As will be apparent from FIG. 5, means are provided for applying tension to the yarn while it is being printed. This is important in that the yarn is maintained in a straightened and flattened condition free of any folds, wrinkles or the like, and is precisely aligned with respect to the alignment of the printed pattern 50 on the rolls 21. Such alignment is a critical and important feature in accordance with his invention.

Although a variety of mechanical means may be provided for applying such tension, FIG. 5 shows schematically a special roll having a clasp 52 attached to the forward end of the knitted tubing 12. Rotation, after grasping the leader with the clasp 52, applies tension not only at the outset but throughout the printing operation.

FIGS. 6 and 7 show highly preferred patterns in accordance with this invention. In FIG. 6 the pattern is hexagonal and repeats continuously throughout the area of the printing portion of the printing roll.

The pattern shown in FIG. 7 is a so-called checkerboard pattern. In accordance with a specific embodiment of this invention, such a checkerboard pattern may contain only three colors such as black, gray and white (uncolored). Surprisingly, the yarn that is produced after deknitting such a color combination, utilizing such a checkerboard pattern, has an unexpected and pleasing pepper and salt appearance.

FIG. 8 shows the upper surface (both surfaces having been printed) of a tape 12. Typically, the hexagonal areas may be colored as follows: 60 brown, 61 yellow, 62 dark blue, 63 red 64 orange, 65 green, 66 pale blue and 67 purple.

This may be accomplished with the use of only three primary colors, some superimposed upon others in accordance with a predetermined sequence, or with the use of a multiplicity of separate and distinct dyes. In the event that such colors are utilized in the printing on the tubing, these colors are translated into the yarn upon deknitting, as appears from an examination of the dash line in FIG. 8, which shows a typical line of de-knitting.

As has been previously stated, when there is a partial overlap of the printed pattern, it has been found that the finished yarn has an even greater degree of randomness of color.

Referring to FIG. 9, a yarn is shown being deknitted and wound upon a winder 2. The section 60 from FIG. 8, which as shown, is generally arrow-shaped and of finite length, produces a brown dash 60 in the fabric of FIG. 9 and similar portions 61 to 67 produce the corresponding colors yellow, dark blue, red, orange, green, pale blue and purple in the yarn of FIG. 9, as will now be apparent.

Accordingly it is important to provide a multiplicity of colors extending in a wale-wise and in a course-wise direction in the knitted fabric, so that the deknitting of the fabric produces a yarn having a multiplicity of short dashes of different colors arranged in succession with each other, each dash having a dimension of one inch or less, preferably considerably less. The length of such a dash on the yarn, after deknitting, is greater than the width of the corresponding printed area on the tape.

Although FIGS. 1 to 9 have shown a process for producing yarn from a single tape, multiple tapes may be utilized instead.

FIG. 10 shows, in a plan view, a plurality of knitting machines 11 provided with a plurality of pressing means P, producing a plurality of tapes 12. These tapes 12 are printed concurrently through elongated pairs of printing rolls 21, 22 and 23 in a manner substantially similar to the process previously described herein. A multiplicity of aligning spools 20 are provided, before and after the printing rolls, in order to assure precise alignment of the tapes 12 with respect to the printed areas on the printing rolls.

Figure 12:
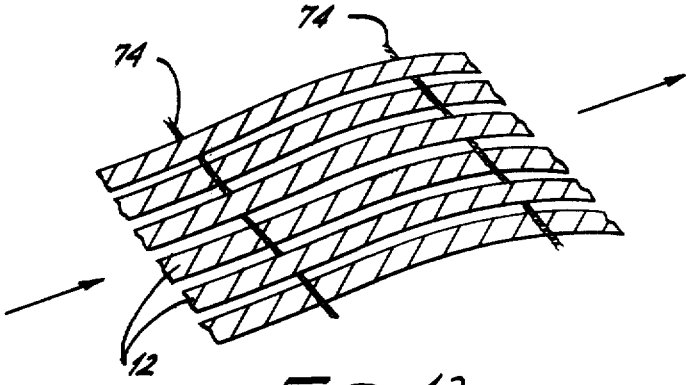
FIG. 12 is a view in perspective of typical leased tapes in accordance with the procedure illustrated in FIGS. 10 and 11.

At the right hand portion of FIG. 10, an interlacing means is shown, for interlacing the tapes to produce an interlaced "fabric" of the tapes. This means includes supporting rolls 69, 69, special rolls 70, 71 having raised diameter portions 72, and smaller diameter portions 73, which are alternately arranged along the axis, and which provide support for alternate members of the tapes 12. In this manner, as shown in FIG. 11, some of the tapes 12 are raised and others are lowered, forming a shed through which leasing of interlacing yarns 74, 74 are inserted in known manner. This produces a leased or interlaced fabric containing a multiplicity of tapes 12, as shown in FIG. 12. Such interlaced fabrics may, of course, be conducted as fabrics through the subsequent heat-setting and deknitting operations, with great manufacturing convenience and economy.

Figure 13:
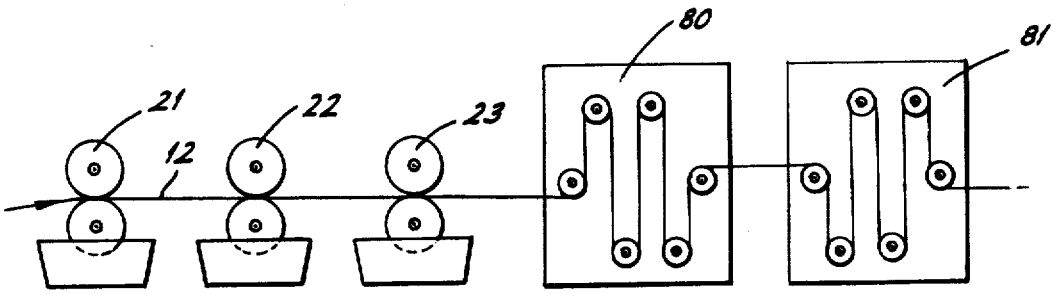
FIG. 13 is a view in side elevation of a printing, drying and setting continuous process in accordance with one aspect of this invention.

FIG. 13 shows a process similar to FIG. 2, and like components are similarly numbered. It is important in accordance with this invention, particularly with the use of "thermasol" dyeing, to pass the printed tapes through heating chambers or steam. As shown, the chamber 80 is provided to apply dry heat, and the chamber 81 is provided with steam in order to provide wet heat, producing a particularly excellent combination in accordance with this invention. Heating in the chamber 80 may utilize a temperature of 390°–430° F. for polyester, and chamber 81 may contain dry heat at 400° or steam at about 390°–400° F. The steam may either be saturated or superheated. Twenty seconds exposure is sufficient in many cases.

Figure 14:
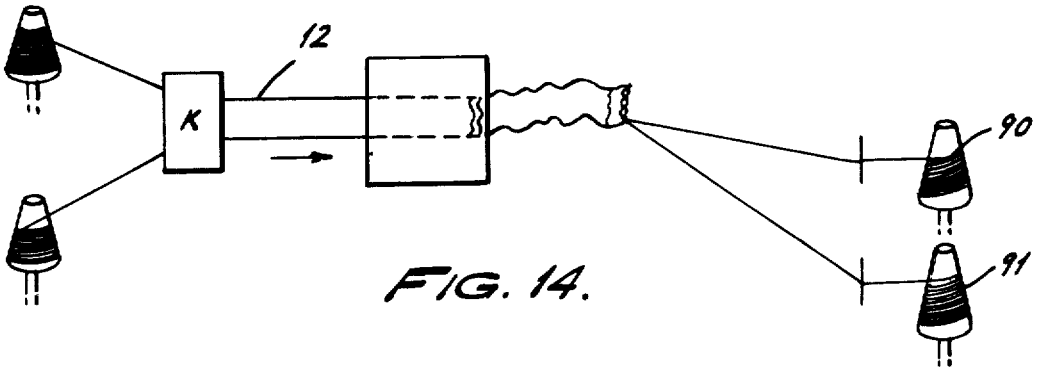
FIG. 14 is a schematic view in plan, showing one form of this invention involving multiple knitting and multiple deknitting.

FIG. 14 shows a multiple knitting process which is useful in accordance with this invention, and which produces an excellent product with greater volume. In accordance with this invention, 2, 4, 7, 8 or even more feeds may be used in a knitting machine, in order to provide novel effects with respect to color, and also greater capacity. As shown in FIG. 11, the knitting machine K has two feeds, as shown, and the tape is processed as heretofore described. Each end is then separately de-knitted, onto separate cones 90, 91 as shown. This creates a smoother, less wavy type of knit deknit yarn, which is highly desirable for many purposes.

Figure 15:
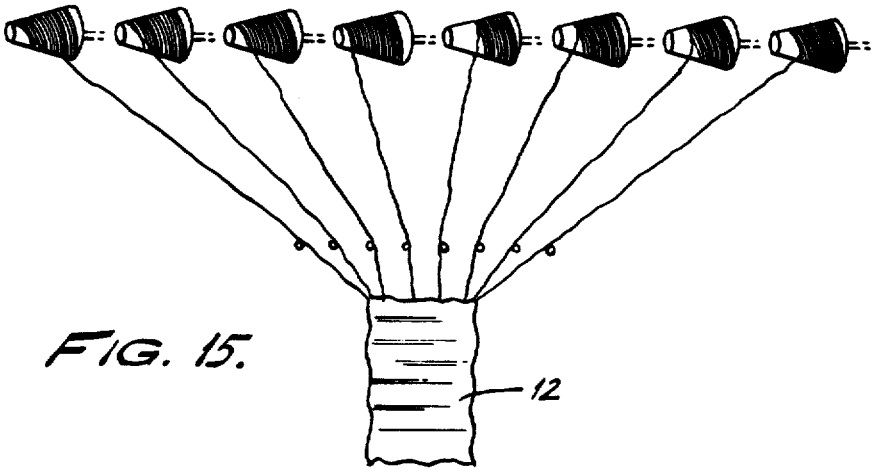
FIG. 15 is a view similar to FIG. 15, showing the manner of deknitting a fabric circular knit with eight feeds.

FIG. 15 shows an extension of the concept illustrated in FIG. 14, showing 8 yarns being simultaneously deknitted from the knitted tape 12.

FIG. 16 shows an alternative embodiment in accordance with this invention, wherein the yarn is not knitted into a tape. Instead, multiple ends of the yarn taken from bobbins 100, 101, are fed through guides 102, 103 through a stuffer crimper 104. Such a stuffer crimper produces yarns having a multiplicity of substantially V-shaped crimps, or having a saw-tooth configuration, as is well known in the art. Guide pins 105 are provided, for feeding these yarns to a beam 106 for further processing as will further become apparent hereinafter.

Referring to FIG. 17, the beam 106 containing a multiplicity of stuffer box crimped yarns is formd into a warp 107 and the yarns are fed as a warp, under tension, through printing rolls 21, 22 and 23. After processing in accordance with this invention, including heat setting or steam setting or both, the yarns are separated from each other and from the warp, and are taken up on a multiplicity of take-up bobbins. In such a manner, the yarns are spaced very closely to each other by a multiplicity of pins 111 prior to printing, and a precise pattern is provided on the thus precisely aligned and closely spaced yarns, such pattern having all of the characteristics heretofore described in connection with the preceding figure. A stuffer crimped yarn of the type illustrated herein is useful in the production of multicolored fabrics, and may be combined with knit deknit multicolored yarns in accordance with this invention to produce a fabric having a modified effect, having a different appearance from the typical knit deknit fabric. Yarns of these different types may be combined in a wide variety of proportions, but it is important that they be multicolored yarns in accordance with this invention. That is to say, it is important that they be yarns which are textured and multicolored, having a multiplicity of short dashes of at least five different colors arranged adjacent each other along the yarn direction, the dashes having an average length of about one inch or less.

Yarns in accordance with this invention may have a wide variety of different deniers. Although deniers of 80 and 150, and other apparel deniers are particularly preferred, and are responsive to the advantages of this invention to an accentuated degree, other deniers may be utilized, either smaller or larger, in many cases. It is important to note that this invention avoids and eliminates the expense and inconvenience associated with the use of paper tapes, which have heretofore been utilized in connection with the "thermasol" dyeing process. Surprisingly, by direct application of thermasol colors to the tape, even with the use of polyester yarns, although the tape does not initially appear to possess excellent or brilliant color characteristics, the subsequent heat treatment of the tape causes the colors to come to life, and to assume an unexpected brilliance.

The yarns in accordance with this invention may be polyester, nylon, "Antron", or the like and may even include spun yarns, Orlon, or natural yarns such as cotton, wool, etc.

The number of colors to be applied to the same yarn is virtually unlimited. In accordance with this invention at least five colors must be applied in order to obtain the novel effects achieved herein, but a much greater number such as 18 or more colors on the same yarn, has been achieved.

Although specific hexagonal and checkerboard patterns have been disclosed in the drawings herein, other patterns may be substituted, but it is essential that they must apply at least five colors in the deknitting direction, across the tape, and each color of the pattern applied to the tape must have a dimension of about one-half inch or less, in the deknitting direction.

Although the printing operation is preferably conducted on both sides of the tape, the amount of dye applied in the patterns should be controlled so that the dye does not soak through.

Although reference has heretofore been made to dimensions of about one-half inch to one inch, with respect to the short dashes of colors succeeding each other along the length of the yarn, dashes which are much smaller may be utilized, all the way down to one thirty-second of an inch, or even smaller. It is of the essence of this invention to provide a multiplicity of short dashes of different colors, because these produce a yarn having the highly desirable appearance of the yarn in accordance with this invention.

Although reference has been made specifically with respect to the "thermasol" dyes, many different dyes may be utilized provided they are suitable for the material of the yarn. Basic cationic dyes may be used with acrylics, and many different dyes may be used with many different synthetics such as polyamides, polyesters or the like. Yarns in accordance with this invention may be continuous filament or spun, or combinations thereof. Indeed, rovings may be used instead of yarn, provided the rovings are carefully fed and aligned with the printing apparatus in accordance with this invention.

The step of pre-heating the tapes, utilizing the block heaters associated with the knitting machines, not only provides the tape in a straightened and flattened condition, but also pre-conditions the polymer when a synthetic polymer is used, making it more receptive to the subsequent action of the steam in bringing out the brilliance of the dyes. As stated, the steam utilized in the autoclaving step not only sets the yarn but concurrently drives the dye into the yarn. It has been found that wet heat sets the dyes better than dry heat, at a lower temperature.

Although this invention has been described with reference to certain specific forms thereof, and with reference to certain sequences of steps of the method, it will be appreciated that a wide variety of other variations may be made without departing from the spirit and scope of this invention, which is defined in the appended claims.

I claim:

1. In a method of making multicolored yarn, having a multiplicity of short dashes of different colors arranged in succession, the steps which comprise:

knitting said yarn into a tubular prefabric tape, straightening and flattening said tape, preheating said tape, feeding said tape walewise in a straightened and flattened condition and while so feeding said tape, printing at successive upstream and downstream locations spaced wale-wise along said tape, upon both sides of said tape a multicolor design comprising a multiplicity of individual areas printed with dyes having different colors in the course-wise direction at least about every ½ inch or less, said design also comprising a multiplicity of individual areas having a predetermined length in the wale-wise direction, said multicolor design continuous in both the course-wise and in the wale-wise directions, overprinting at said downstream location a further color on at least some of said areas previously printed with a different color, in a manner to produce a plurality of additional colors in addition to those previously printed, whereby the resulting multicolor design includes at least five different colors in the course-wise direction, each color applied to said tape having a dimension of about one-half inch or less, heat setting the resulting printed tape, deknitting said tape, and taking up the resulting multicolored yarn.

2. The method defined in claim 1, wherein said tape is composed of yarn of apparel denier.

3. The method defined in claim 1, wherein said tape is pressed prior to said printing step.

4. The method defined in claim 1, wherein said tape is tensioned during said printing step.

5. The method defined in claim 1, wherein said printing step includes the application to said tape of a disperse dye, and wherein said tape is subjected to heat subsequent to printing and before deknitting.

6. The method defined in claim 5, wherein said heating step comprises heating with steam under pressure.

7. The method defined in claim 6, wherein said steam is saturated steam.

8. The method defined in claim 6, wherein said steam is superheated steam.

9. The method defined in claim 1, wherein said printed design comprises a multiplicity of small geometrically repeating figures of different colors immediately adjacent one another.

10. The method defined in claim 1, wherein said design is a checkerboard design.

11. The method defined in claim 1, wherein said design is an elongated hexagonal design.

12. The method defined in claim 1, wherein said printing step comprises a plurality of printing steps applying similar designs successively to said tape, the sequence and timing of said application of designs being synchronized with each other and with the speed of movement of said tape.

13. The method defined in claim 1, wherein said tape is formed with smooth, straight side edges and said edges are guided for precise alignment with respect to said printing operation.

14. The method defined in claim 1, wherein said tape is preheated prior to printing, and is subjected to steam heat before deknitting, at a temperature and for a time sufficient concurrently to heat-set said yarn and develop said dye.

15. The method defined in claim 14, wherein at least one of said dyes is a disperse dye.

16. The method defined in claim 1, wherein a plurality of said tapes is printed while running side by side and substantially parallel to one another.

17. The method defined in claim 16, wherein said tapes are interlaced with one another to form a temporary fabric of which said tapes are arranged warp-wise.

18. The method defined in claim 17, wherein said temporary fabric is heat treated as a fabric.

19. The method defined in claim 17, including the further step of deinterlacing said tapes followed by applying said deknitting step to all said tapes.

20. The method defined in claim 1, wherein said tape is collected in a net and wherein said heat setting step is applied while said tape is still in said net.

21. The method defined in claim 1, wherein at least three such upstream and downstream locations are provided, and wherein a different primary color is applied to the tape at each such location, and wherein primary colors are overprinted upon other primary colors at said downstream location to produce the resulting multicolor design in at least five different colors in the coursewise direction.

22. In a method of making multicolored yarn, having a multiplicity of short dashes of different colors arranged in succession, the steps which comprise:

knitting said yarn into a tubular prefabric tape, straightening and flattening said tape, preheating said tape, feed said tape wale-wise in a straightened and flattened condition and while so feeding said tape, printing at successive upstream and downstream locations spaced wale-wise along said tape, upon both sides of said tape a multicolor design comprising a multiplicity of individual areas printed with dyes having different colors in the course-wise direction at least about every ½ inch or less, said design printed in synchronization on both sides of said tape, said design also comprising a multiplicity of individual areas having a predetermined length in the wale-wise direction, said multicolor design being continuous in both the course-wise and in the wale-wise directions, overprinting at said downstream location a further color on at least some of said areas previously printed with a different color, in a manner to produce a plurality of additional colors in addition to those previously printed, whereby the resulting multicolored design includes at least five different colors in the course-wise direction, heat setting the resulting printed tape, deknitting said tape, and taking up the resulting multicolored yarn.

23. In a method of making multicolored yarn, having a multiplicity of short dashes of different colors arranged in succession, the steps which comprise:

knitting said yarn into a tubular prefabric tape, straightening and flattening said tape, preheating said tape, feeding said tape wale-wise in a straightened and flattened condition and while so feeding said tape, printing at successive upstream and downstream locations spaced wale-wise along said tape, upon both sides of said tape a multicolor design comprising a multiplicity of individual areas printed with dyes having different colors in the course-wise direction at least about every ½ inch or less, said design being printed out of synchronization on both sides of said tape, said design also comprising a multiplicity of individual areas having a predetermined length in the wale-wise direction, said multicolor design being continuous in both the course-wise and in the wale-wise directions, overprinting at said downstream location a further color on at least some of said areas previously printed with a different color, in a manner to produce a plurality of additional colors in addition to those previously printed, whereby the resulting multicolored design includes at least five different colors in the course-wise direction, heat setting the resulting printed tape, deknitting said tape, and taking up the resulting multicolored yarn.

* * * * *